US009365272B1

(12) United States Patent
Foglia

(10) Patent No.: US 9,365,272 B1
(45) Date of Patent: Jun. 14, 2016

(54) HAND CRANK STAND-UP PADDLE BOARD

(71) Applicant: Silvino R. Foglia, Jupiter, FL (US)

(72) Inventor: Silvino R. Foglia, Jupiter, FL (US)

( * ) Notice: Subject to any disclaimer, the term of this patent is extended or adjusted under 35 U.S.C. 154(b) by 0 days.

(21) Appl. No.: 14/856,734

(22) Filed: Sep. 17, 2015

(51) Int. Cl.
*B63H 16/20* (2006.01)
*B63H 16/08* (2006.01)
*B63B 35/79* (2006.01)

(52) U.S. Cl.
CPC ..... *B63H 16/12* (2013.01); *B63B 35/7906* (2013.01); *B63H 16/20* (2013.01)

(58) Field of Classification Search
CPC ..... B63B 35/73; B63B 35/74; B63H 16/00; B63H 16/12; B63H 16/14; B63H 16/20; B63H 2016/202; B63H 1/04
USPC ..... 440/21, 26, 27, 30, 90
See application file for complete search history.

(56) References Cited

U.S. PATENT DOCUMENTS

| | | | | |
|---|---|---|---|---|
| 1,578,584 | A | 3/1926 | Cromer | |
| 2,317,905 | A * | 4/1943 | Galkin | B63B 35/73 440/26 |
| 3,083,382 | A | 4/1963 | Havens et al. | |
| D221,405 | S | 8/1971 | Schropfer | |
| 3,779,202 | A | 12/1973 | Martin et al. | |
| 4,321,048 | A | 3/1982 | Marchese et al. | |
| 4,464,126 | A | 8/1984 | Maisonneuve | |
| 4,474,502 | A | 10/1984 | Daoud | |
| 4,648,846 | A | 3/1987 | Hsu | |
| 4,772,237 | A | 9/1988 | Zalkauskas | |
| 4,968,274 | A | 11/1990 | Gregory | |
| 5,368,507 | A | 11/1994 | Harris | |
| 5,427,554 | A | 6/1995 | Foglia | |
| 5,453,031 | A * | 9/1995 | Gagnier | B63H 16/12 440/26 |
| 5,643,020 | A | 7/1997 | Harris | |
| D399,814 | S | 10/1998 | Toro et al. | |
| 6,033,276 | A | 3/2000 | Han | |
| 6,257,944 | B1 | 7/2001 | Herrod | |
| 7,097,521 | B1 | 8/2006 | Papadakis | |
| 7,232,350 | B1 | 6/2007 | Krah | |
| 7,267,586 | B1 | 9/2007 | Murphy | |
| 7,371,138 | B2 | 5/2008 | Spass | |
| 7,699,017 | B1 | 4/2010 | Marshall | |
| 7,736,205 | B2 | 6/2010 | Krah | |
| 7,931,512 | B2 | 4/2011 | Bortsov et al. | |
| 8,043,134 | B2 | 10/2011 | Krah | |
| 8,246,407 | B2 | 8/2012 | Roland | |
| 8,752,492 | B1 | 6/2014 | Harris | |
| 8,936,500 | B1 * | 1/2015 | Ebrahimi | B63B 35/7916 441/76 |
| 8,992,272 | B1 | 3/2015 | Malakiman | |
| 9,033,753 | B2 | 5/2015 | Siverts et al. | |
| 9,051,038 | B1 | 6/2015 | Herber | |
| 9,056,220 | B2 | 6/2015 | Richards et al. | |
| 9,061,557 | B1 | 6/2015 | Garrett | |
| 2009/0061703 | A1 * | 3/2009 | Song | B63H 16/14 440/27 |
| 2012/0244764 | A1 | 9/2012 | Farmer | |
| 2013/0231014 | A1 | 9/2013 | Knutson | |
| 2015/0104986 | A1 * | 4/2015 | McHenry | B63H 16/20 440/26 |

* cited by examiner

*Primary Examiner* — Lars A Olson
(74) *Attorney, Agent, or Firm* — McHale & Slavin, P.A.

(57) ABSTRACT

This invention pertains to an aquatic stand up board where the rider is standing on the board and provides propulsion by means of a manual hand crank. The hand crank operates two sprockets and a chain causing a double paddle wheel beneath the board to rotate thereby providing thrust. Forward or backward motion depends on whether the manual crank is rotated clockwise or counterclockwise. Steering is achieved by turning the crank in a horizontal plane, similar to a bicycle handlebar, which rotates the paddle wheels in the desired direction.

11 Claims, 4 Drawing Sheets

HAND CRANK STAND-UP PADDLE BOARD

FIELD OF THE INVENTION

This invention relates to the field of stand-up paddle boarding and in particular, to a stand-up paddle board having a human powered propulsion system directed by a hand crank.

BACKGROUND OF THE INVENTION

Stand-up paddle boarding ("SUP") is an activity based upon the sport of surfing. Surfing being an activity that allows an individual to move in accordance with the motion of a wave, requiring the individual to lay on the board to hand paddle when the motion of the wave is not available. This is a common mode of propulsion when a surfer is moving from one location to another.

The movement of a surfboard without the motion of a wave has become a sport in and of itself. In particular the surfboard is used as a platform and wherein an individual stands up on the board and propulsion is caused by use of a paddle board. The paddle board is operated by the individual requiring balance and strength in order to successfully move the board from one location to another.

SUP has created a following wherein SUP races are commonly held throughout the world. In many instances it is difficult for beginners or those not so athletically inclined to maintain their balance upon a SUP. In such instances the individual may frequently tip the board over and/or lose the paddle. In either event the individual can become frustrated and lose interest in the activity.

What is needed in the art is a board that allows an individual to stand-up on a board yet provide the individual with a raised handle to grasp in order to steady himself. In addition, what is needed is for the raised handle to provide a means to cause human propulsion of the board in a forward, rearward, or sideward direction.

DESCRIPTION OF RELATED ART

U.S. Pat. No. 9,051,038 discloses a paddle board that includes a propulsion device that utilizes paddle wheels positioned on either side of the board. The paddle wheels are driven by a foot operated drive mechanism that utilizes elliptical type of pedaling by the user. Hand controlled rudders control the direction of travel.

U.S. Pat. No. 4,321,048 discloses a water board wherein a screw propeller mounted on the underside of the board generates thrust in response to the push-pull action of a hand lever which protrudes from either side of the board. The push-pull action on the lever causes a ratchet-type mechanism to rotate a gear assembly which is connected to the screw propeller shaft.

U.S. Pat. No. 8,992,272 discloses a stand-up pedal board wherein propulsion is provided by applying alternating downward force to foot pedals to swing a fin side to side through transfer of energy from foot pedal shafts rotating around a T brace.

U.S. Pat. No. 4,968,274 discloses a catamaran hull with bicycle pedals used to drive a propeller to propel the hull. The foot pedaling action may be augmented by lines secured to the pedals so the operator can pull each pedal manually on return. Turning is achieved by the operator leaning to either side which causes the rear pontoons to pivot right or left correspondingly.

U.S. Design Pat. No. 399,814 discloses a small boat having a pedal operated propulsion perspective view of an aquacyle.

U.S. Pat. No. 5,427,554 discloses a recreational water craft which is manually powered. Outrigger floats are provided with a vertical extension on which is mounted an independently operated paddle wheel. The paddle wheels each have a handle or hand grip on their inboard surface, which can be adjusted relative to the axis of rotation of each of such wheel, to accommodate the crew member's reach and his location on the main float.

U.S. Pat. No. 7,371,138 discloses a pedal boat drive comprising a pedal crank and a drive train for transferring drive energy produced by the pedal crank to a propeller. At least one flywheel, which is mounted on a free-running axle, is placed in the drive train between the pedal crank and the means of propulsion. Drive energy produced by the pedal crank is transferred from the pedal crank to the flywheel, which is mounted in a free-running manner, and is transferred from said flywheel to the means of propulsion.

U.S. Pat. No. 8,043,134, discloses a watercraft having a deck configured with a rocker having graspable input arm above-deck and a lower output arm, the first rocker being pivoted to the craft, the output arm connecting a push-bar at a first end and the push-bar having a second end connecting a second rocker, the second rocker having input and output arms, the output arm of the second rocker having a propelling fin, the second rocker being pivoted to the watercraft. The watercraft may have a third rocker, fin, and pivot, and more. Users stand upon deck, grasp the first rocker's input arm and vertically thrust the rocker to propel.

SUMMARY OF THE INVENTION

An aquatic stand up board, similar to a paddle board or surf-board, where the individual stands on the board having a raised handle to steady themselves. From the raised handle, propulsion is provided by means of a manual crank located on the raised handle which is based upon a vertical shaft that extends from the board to a position where the individual can grasp the manual crank for rotation. The manual crank is coupled to a paddle wheel beneath the board by use of two sprockets and a chain, rotation of which providing thrust through the paddlewheel. Forward or backward motion depends on whether the manual crank is rotated in a clockwise or counterclockwise. Steering is achieved by turning the crank in a horizontal plane, similar to a bicycle handle bar, which rotates the paddle wheels in the desired direction.

An objective of the invention is to provide an improved stand-up paddle board.

Still another objective of the invention is to provide a paddle board that is less prone to tipping by positioning a handle system in the middle of the paddle board.

Still another objective of the invention is to provide a paddle board wherein the paddle and operating mechanism are attached to the board to prevent loss.

Yet still another objective of the invention is to provide a dual paddle wheel design having a solid disc on the inboard sides to minimize cavitation from the individual paddles.

Other objectives and further advantages and benefits associated with this invention will be apparent to those skilled in the art from the description, examples and claims which follow.

DETAILED DESCRIPTION OF THE PREFERRED EMBODIMENT

Figure 1:
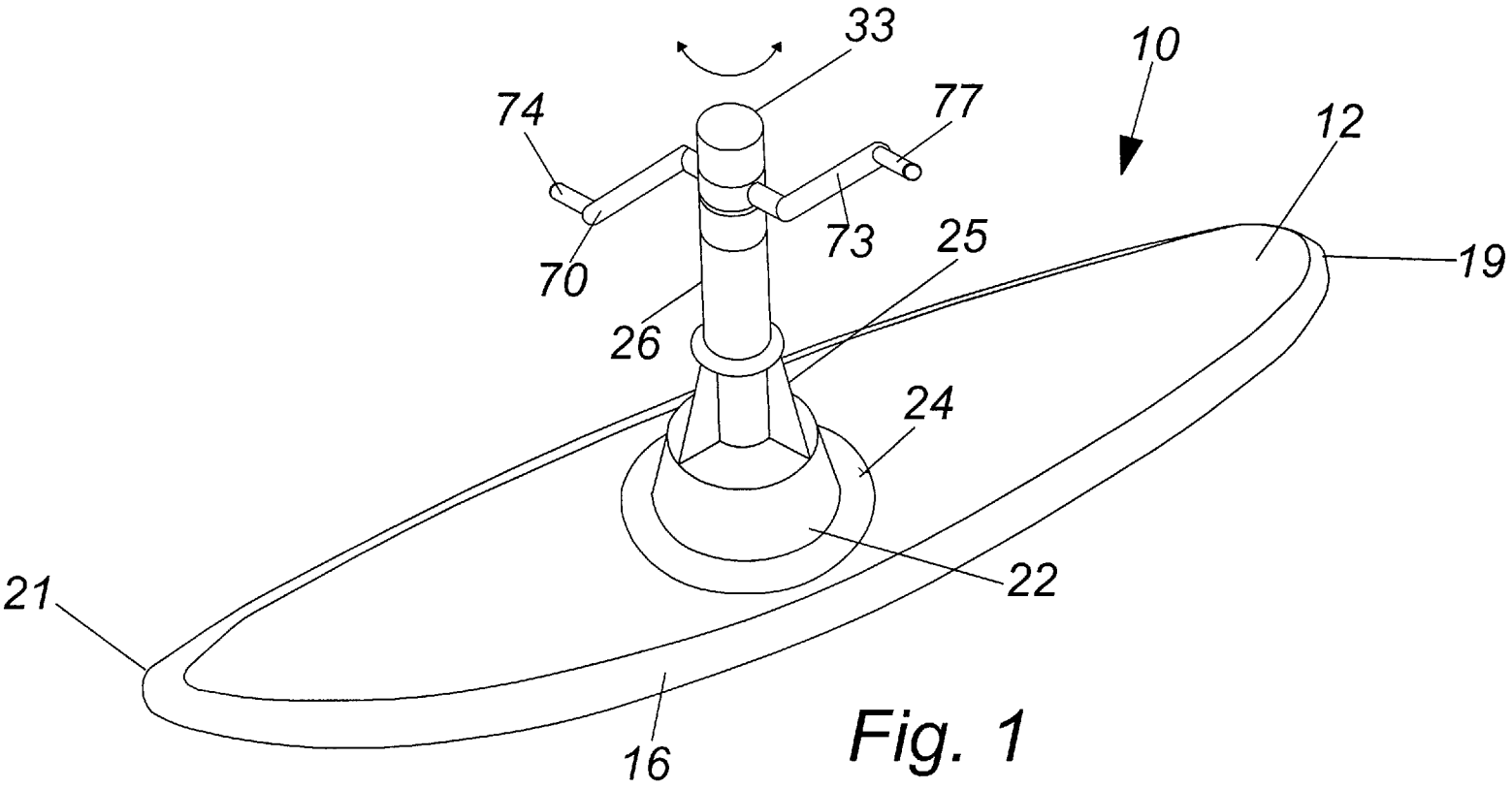
FIG. 1 is a perspective view of the stand-up paddle board of the instant invention.
Figure 2:
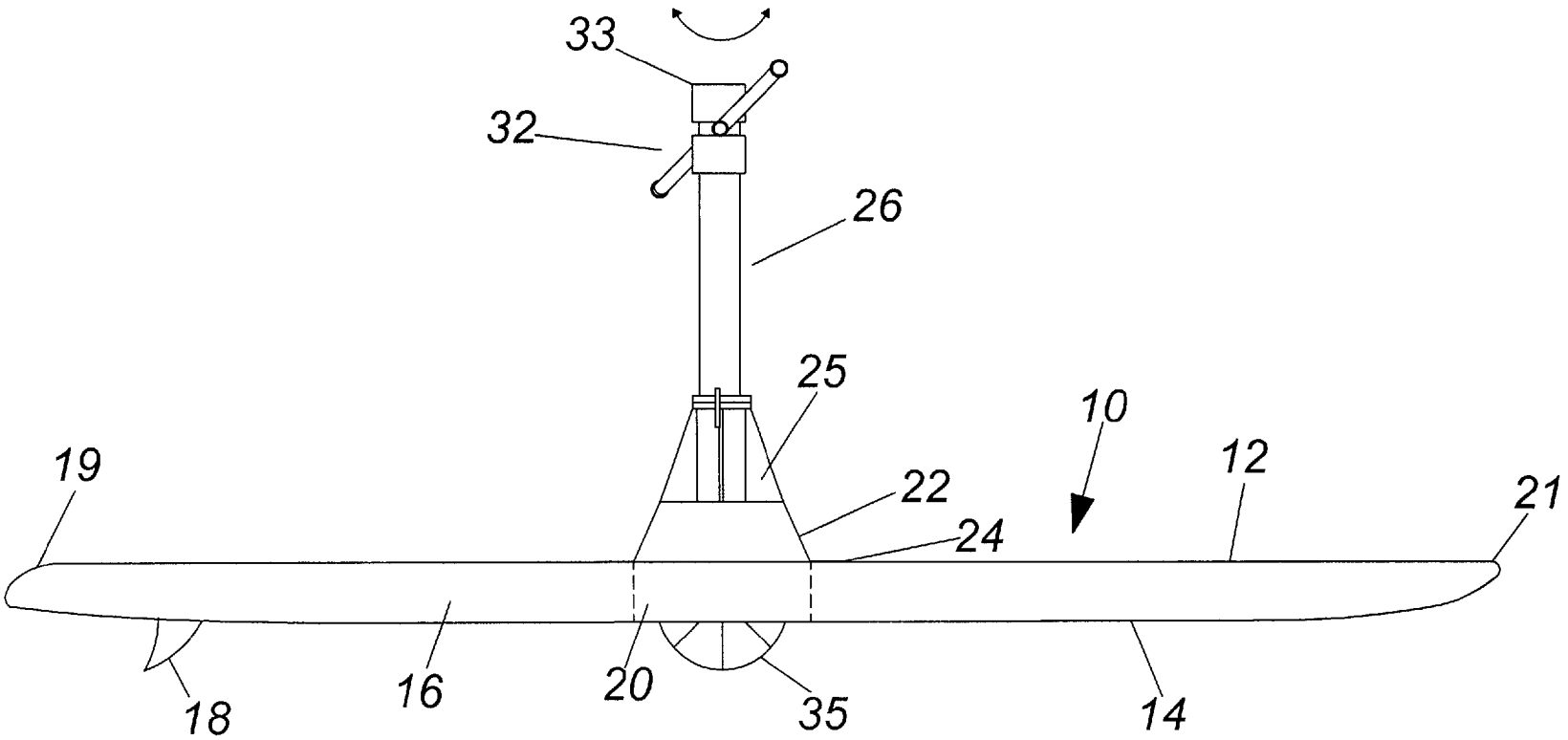
FIG. 2 is a side view thereof.

Referring to FIGS. 1 and 2, illustrated is the stand-up paddle board 10 of the instant invention. Paddle boards can be made of any length but are typically range from nine feet to about fourteen feet long. The shape of the board varies between manufacturers but otherwise assimilate a conventional surfboard constructed either from a foam core wrapped in a fiberglass and epoxy skin or other materials. The paddle board is defined by an upper surface 12, a lower surface 14, and a continuous shaped sidewall 16. A stabilizing fin 18 is secured to the lower surface 14 of the board 10 along a tail end 19, opposite the leading end 21. A centrally disposed aperture 20 is placed through the board 10 for receipt of a conical shaped housing base 22 that is secured to the upper surface 12 of the board 10 over the aperture 20. The housing base 22 includes a flange 24 that allows for permanent attachment of the housing base 22 to the board 10 by fasteners such as screws (not shown), glue or lamination within the fiberglass skin. A column 26 is sized to provide a handle at a distance above the upper surface 12. The column 26 holds the propulsion system mechanism and serves also as the steering column. The upper end of the column 26 contains a manual crank system 32. The manual crank 32 is coupled to a paddle wheel assembly 35 as later herein defined.

Figure 3:
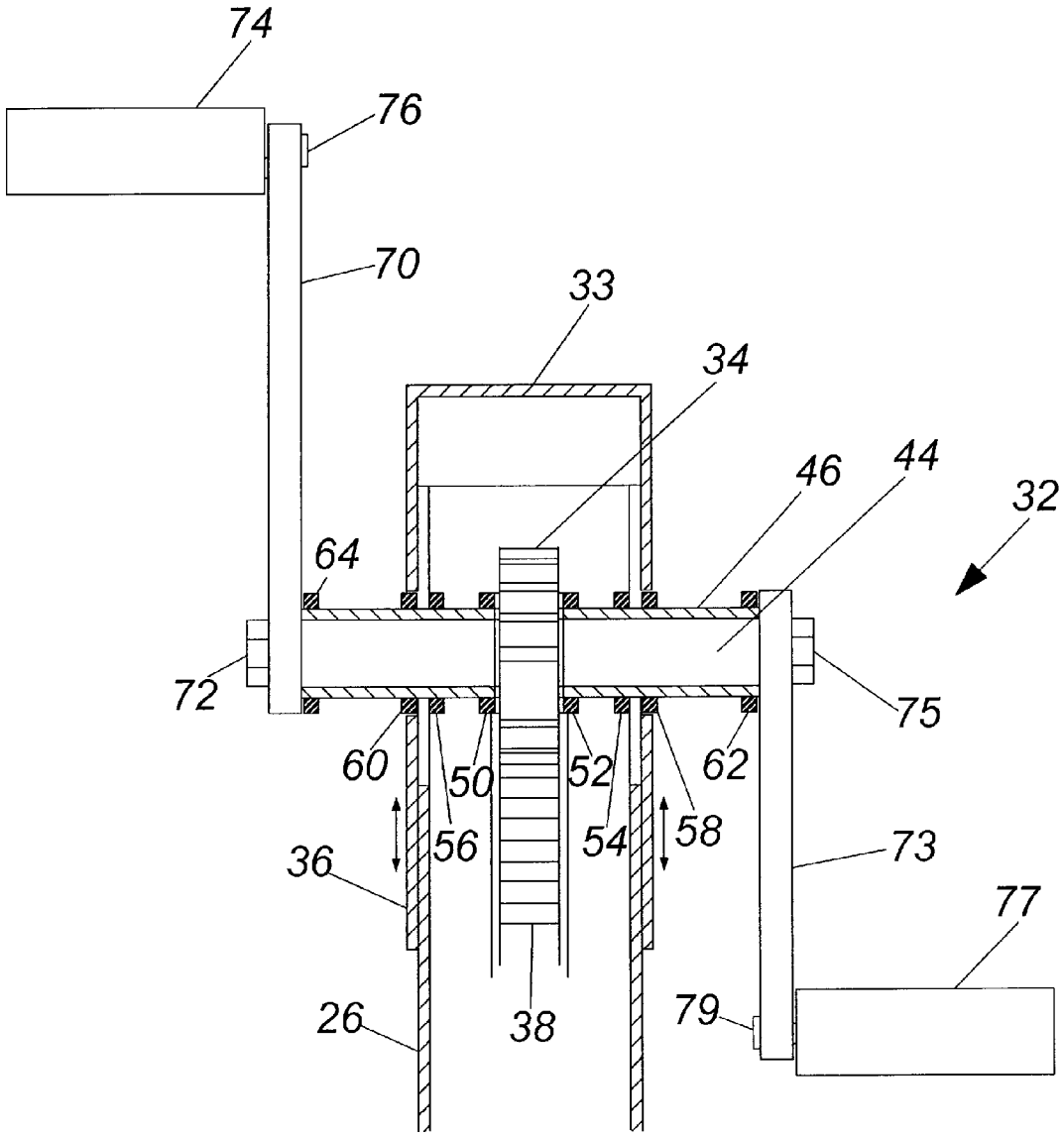
FIG. 3 is a front view of the crank assembly cross section.

Referring to FIG. 3, the top section of column 26 includes a top retainer cap 33 used to prevent the upper sprocket 34 assembly from sliding upward. A slotted sleeve 36 is adjusted up or down to achieve proper tension of a drive chain 38 and then fastened by screws or the like to maintain the position and proper tension to the drive chain 38. The top retainer cap 33 also serves as a protective cover to the upper sprocket 34 and drive chain 38. It should be noted that the drive chain 38 and sprockets 34 and 40 may be made of plastic, metal, fabric or any type of material capable to achieve the needed torque to actuate the paddle wheels 100 and 101 assembly. While in most instances the drive chain 38 can be made of light weight and fairly soft materials, should a SUP be used in a sporting activity such as racing the drive chain may be made of metal in order to handle the high stress imposed by a non-recreational individual. The upper sprocket 34 is assembled to a shaft 44 housed in a shaft housing 46. On each side of the sprocket 34 are securement rings 50 and 52 which maintain the position of the upper sprocket 34 in a central position of the shaft 44. Middle rings 54 and 56 are attached to the inward portion of the shaft housing 46 and outset rings 58 and 60 are attached to the outward portion of the shaft housing 46 to guide and retain the sprocket 34 in a central position of column 26. Rings 62 and 64 are at the end of the shaft housing 46 and operate as bearing areas to the cranks 70 and 73. A first crank 70 is bolted 72 to the first end of the shaft 44 having rotating handle 74 bolted 76 to the first crank 70. A second crank 73 is bolted 75 to the second end of the shaft 44 having rotating handle 77 bolted 79 to the second crank 73.

Most of the components, if not all, can be made of plastic such as polyethylene by utilizing injection and rotational molding processes. This simplifies the manufacturing of the various parts and lowers assembly time. For example, the sprockets and their respective shafts can be made as one component, similarly for the housing 22 together with flange 24 and stiffening braces 25 can be made as one part by utilizing the rotational molding process; by means of injection molding each paddle wheel can be made as one component. By utilizing these processes the weight and cost of the board are significantly reduced.

Figure 4:
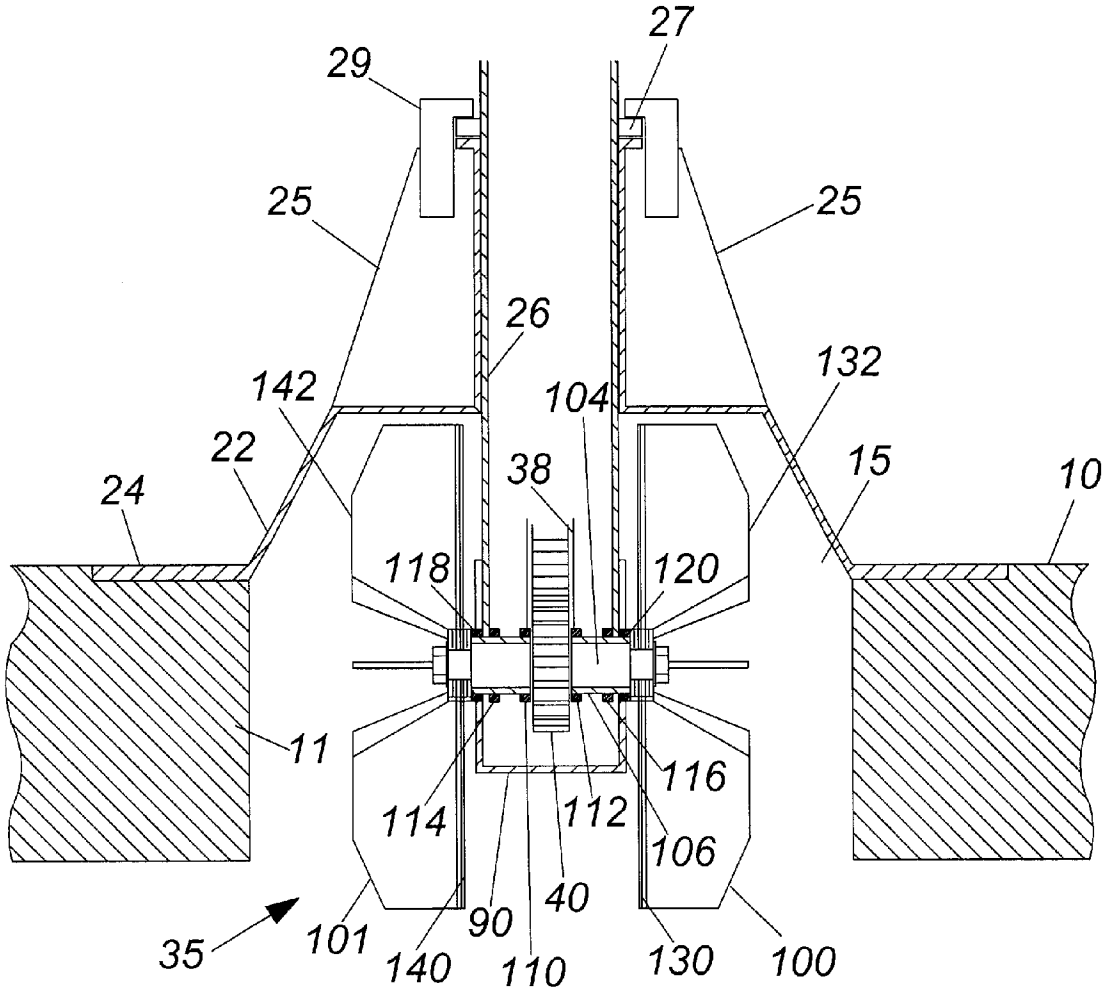
FIG. 4 is a front view of the paddle wheel assembly cross section.

Referring to FIG. 4, the lower section of the column 26 consists of a bottom cap 90 which retains the lower sprocket assembly 40 and serves as the protective cover to the sprocket 40 and drive chain 38. Note that the cap 90 can be made longer so that its bottom would be lower than the outer circumference of the paddle wheels 100 and 101 thus protecting the paddle wheels from touching bottom in shallow waters. The lower sprocket 40 is attached to shaft 104 which is housed in a spacing sleeve 106. On each side of the shaft 104 are securement rings 110 and 112 which maintain the position of the lower sprocket 40 in a central position on the shaft 104. Middle rings 114 and 116 are attached to the inward portion of the shaft housing 106 and outset rings 118 and 120 are attached to the outward portion of the housing 106 to guide and retain the sprocket assembly 40 in a central position of column 26. The attached rings serve the same purpose as explained for the upper sprocket assembly 34.

Paddle wheel 100 is bolted to one end of the shaft 104 and paddle wheel 101 forms a mirror image of paddle wheel 100 and is bolted to the opposite end of the shaft 104. Paddle wheel 100 is formed from a solid disk 130 on the inboard side to which the individual paddles 132 are attached to. The solid disks 130 help to protect and stiffen the paddle blades and also minimize cavitation interference between the two paddle wheels 100 and 101 by directing water flow. Similarly, paddle wheel 101 is formed from a solid disk 140 on the inboard side to which the individual paddles 142 are attached to. The solid disk 140 helps to protect and stiffen the paddle blades 142 and also minimize cavitation interference between the two paddle wheels 100 and 101 by directing water flow. The paddle wheel assembly (see FIG. 2) and the column 26 are secured to the board 10 by the conical shaped housing 22 which also prevents splashing of the rider by the paddle wheels. The flange 24 of the housing 22 allows to attach the complete assembly to the board 10.

The steering housing 28 and the paddle wheels 22 employ four stiffener braces 25 constructed and arranged to support the column 26 and stiffen the housing 22. The column 26 engages bearing ring 27 to allow ease of turning. As previously mentioned, the column 26 is attached to the paddlewheel assembly wherein turning of the column 26 allows the paddlewheel assembly to turn in the direction that the column 26 is facing. Turning the column 90° would allow the paddlewheel assembly 35 to rotate in a direction perpendicular to the length of the board, causing the board to move sideways. The bearing ring 27 is securely attached to column 26 and sits on the upper flange of 28. Brackets 29 prevent column 26 from moving upward.

The housing 22 forms a cavity 15 beneath the board 10. The shaft 104 of the paddlewheels 100, 101 is centrally mounted about in the middle of the core 11 wherein about half of the paddles 132 and 142 are above the water line for part of the rotation above the middle of the core 11 when the board is properly loaded and the remainder of the water paddles 132 and 142 are beneath the water line for propulsion purposes.

The crank arms 70 and 73 can be made of different lengths for the individual user's comfort. The crank arms can be installed pointing in the same direction, if the rider/operator prefers both of his arms to move the same way at all times allowing the crank to operate in a pump action wherein both crank arms 70 and 70 are rotated such that handles 74 and 77 are in the same position at all times. Alternatively the crank arms are diametrically opposed wherein the handles are positioned 180 degree apart. In this manner the first crank arm can form a mirror image of the second crank arm allowing the crank assembly to operate as a straight line pump. When the first crank arm is positioned diametrically from the second crank arm, the crank assembly operates as a rotational pump. The design of this invention allows easy assembly of the crank and as well as the different components allowing ease of modification or replacement when needed.

Column 26 has two slotted openings from the top edge to a certain distance and opposite to each other; the width of these two opposite slots is the same as the diameter of the two shafts housings 46 and 106. The bottom section of column 26 has also two slotted openings in line with those of the upper section, having the same width and starting at the bottom edge of column 26, except that their length is the same as the diameter of the two shafts housings 46 and 106. This allows for ease of mounting and dismounting of the sprocket-chain assemblies.

The upper sprocket 44 and lower sprocket 40 can be of the same or different diameters establishing different ratios. The optimal ratio of the two sprockets is established by the size of the board 10, the comfort of the rider actuating the crank 32 and the best paddle wheel efficiency. Several sprockets diameters can be made available so that the board 10 can be customized to the stand up rider/operator.

The column 26 further operates as a steering mechanism wherein the turning of the column 26 operates to turn the paddle wheels 100, 101. In this manner while the board is being operated the individual can turn the column 26 by orientation of the crank assembly 32 allowing the board 10 to move in the direction of the paddlewheels. At higher speeds the individual can shift their weight to lessen the need for directional positioning of the paddlewheels.

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

All patents and publications mentioned in this specification are indicative of the levels of those skilled in the art to which the invention pertains. It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A stand-up paddleboard comprising:

a paddleboard having a top surface spaced apart from a bottom surface, a front end and a tail end defining a length with a continuous sidewall forming a cavity therebetween, said cavity filled with a buoyant material;

a propulsion system including a centrally disposed paddlewheel rotatably attached to the bottom surface of said paddleboard;

a hand operated drive mechanism mounted on a column rotatably connected to said paddlewheel by a drive chain such that rotation of the hand operated drive mechanism will cause rotation of said drive chain and cause said paddlewheel to rotate and turning of the column will cause said paddlewheel to turn in the direction of the turned column.

2. The stand-up paddleboard according to claim 1 wherein said paddlewheel assembly is further defined as a first disk and a second disk secured to a lower shaft with a lower sprocket secured therebetween, each said disk having a plurality of blades extending outwardly therefrom.

3. The stand-up paddleboard according to claim 1 wherein said column is secured to said paddleboard directly over said paddlewheel assembly, said column extending above said top surface of said board.

4. The stand-up paddleboard according to claim 1 wherein a hand operated drive system is a hand crank mounted along an upper end of said column, said hand crank including an upper shaft with a centrally disposed sprocket and a first crank arm having a first handle coupled to a first end of said upper shaft and a second crank arm having a second handle coupled to a second end of said upper shaft.

5. The stand-up paddleboard according to claim 3 wherein said first crank arm forms a mirror image of said second crank arm allowing said crank assembly to operate as a pump.

6. The stand-up paddleboard according to claim 3 wherein said first crank arm is positioned diametrically from said second crank arm.

7. The stand-up paddleboard according to claim 1 wherein said drive chain is positioned within said column and is attached to a sprocket on an upper shaft and a lower shaft, wherein rotation of said hand crank causes rotation of paddlewheels.

8. The stand-up paddleboard according to claim 4 wherein said hand crank may be rotated clockwise for forward propulsion or counterclockwise for reverse propulsion.

9. The stand-up paddleboard according to claim 1 wherein said column is adjustable in height.

10. The stand-up paddleboard according to claim 4 wherein each said crank arm is interchangeable with a crank arm of a different length.

11. The stand-up paddleboard according to claim 3 including a housing secured to said paddleboard, said housing rotatably secured to said paddleboard, said housing including at least one stiffing brace to support said column shaft.

* * * * *